United States Patent [19]

Verhille

[11] Patent Number: 4,842,616

[45] Date of Patent: Jun. 27, 1989

[54] METHOD FOR HOMOGENIZING A MIXTURE OF AQUEOUS RESIDUAL LIQUID OR SOLID FUELS

[75] Inventor: Marcel Verhille, Mantes la Jolie, France

[73] Assignee: Sodecim, France

[21] Appl. No.: 191,802

[22] Filed: May 6, 1988

Related U.S. Application Data

[63] Continuation of Ser. No. 913,099, Sep. 29, 1986, abandoned.

[30] Foreign Application Priority Data

Oct. 1, 1985 [FR] France ..... 85 14512

[51] Int. Cl.[4] ..... C10L 1/04

[52] U.S. Cl. ..... 44/51; 44/61; 44/66

[58] Field of Search ..... 44/50, 51, 61, 66

[56] References Cited

FOREIGN PATENT DOCUMENTS

| | | | |
|---|---|---|---|
| 0069909 | 6/1977 | Japan | 44/51 |
| 0012906 | 2/1978 | Japan | 44/51 |
| 0112907 | 10/1978 | Japan | 44/51 |
| 0152785 | 5/1979 | Japan | 44/51 |
| 0094996 | 7/1980 | Japan | 44/51 |
| 2165858 | 4/1986 | United Kingdom | 44/51 |

*Primary Examiner*—William R. Dixon, Jr.
*Assistant Examiner*—James M. Hunter, Jr.
*Attorney, Agent, or Firm*—Darby & Darby

[57] ABSTRACT

The invention relates to a method which makes it possible to produce homogeneous mixtures of industrial wastes such as polluted waters, hydrocarbon wastes and various coal grades, as well as combustible industrial wastes. An essential feature is that the homogeneous mixtures produced in accordance with this invention are stable, and lend themselves to being pumped and injected.

According to the invention, this method consists in forming during a first stage a stable emulsion of oily combustible material in water and during a second stage, in mixing this emulsion with a solid or liquid combustible material.

23 Claims, No Drawings

METHOD FOR HOMOGENIZING A MIXTURE OF AQUEOUS RESIDUAL LIQUID OR SOLID FUELS

This is a continuation application, of application Ser. No. 913,099 filed Sept. 29, 1986.

This invention relates to a method for producing homogeneous and stable mixtures of industrial wastes such as polluted waters, hydrocarbon wastes and various coal grades, as well as combustible industrial wastes. The mixtures produced in accordance with the method of the invention being stable and lending themselves to are pumped and injected.

The method of this invention makes it possible to obtain a relatively thick liquid fuel having a calorific value in the range between 2,500 and 5,000 kcal/kg, while this liquid fuel can be stored, pumped and injected, for instance into the twyers of fireboxes or boilers.

BACKGROUND OF THE INVENTION

There are now existing various methods for forming a suspension of coal in ordinary water or polluted water. However, it is very difficult to add hydrocarbons to such a suspension, because any added hydrocarbon will become adsorbed on the coal particles and will thus form a sludge which will float in the original water phase. For the same reason, it is impossible to grind coal in water and in the presence of hydrocarbons. The objective of the present invention is to overcome these drawbacks.

SUMMARY OF THE INVENTION

The method of this invention is characterized by the fact that in a first stage there is formed a stable emulsion of oily combustible material in water, either polluted water or clean water, and that in a second stage there is added to this emulsion a solid or liquid fuel while vigorously stirring the mixture.

It is essential that the emulsion formed in the first phase of the process should be an emulsion of hydrocarbon in water, and not the reverse.

According to the nature of the hydrocarbon, it may occur that it will be difficult to form an emulsion of this hydrocarbon in water. The formation of this emulsion will then be improved by adding to the water-plus-hydrocarbon mixtures a tensio-active agent or mixtures of tensio-active products in a proportion from 1 to 3 parts per thousand. There may advantageously be used as tensio-active agents non-ionic polyoxyethylene derivatives having an HLB (Hydrophylic Lipophylic Balance) ranging between 15 and 20 and preferably close to 17.

Preferably also, a colloid may be added to the products which are to be emulsified, the proportion of colloid being from 0.5 to 1 percent.

This colloid will have the following threefold role:

stabilizing the emulsion preventing decantation maintaining a state of pseudo-plasticity.

Pseudo-plasticity is meant to express that the liquid will become more fluid when it is stirred; this is important when it is intended that the final product is to be stored in a tank and then pumped and injected.

If heavy and thick hydrocarbons are to be emulsified, the formation of an aqueous emulsion may also be facilitated by adding light and fluid hydrocarbons which will act as solvent or diluters.

In addition to the colloid, there may also be added a silicate, in a proportion from 0.5 to 1 percent. It has in fact been observed in many instances that a silicate would enhance the effect of the colloid.

After a stable aqueous emulsion is obtained, this emulsion is mixed with a solid or liquid fuel, in a suitable stirring device of any known type. In this operation, use can be made of a ground solid fuel, or even, in some cases, of a solid fuel having merely been crushed, grinding being carried out subsequently. It is also possible to use either a pure solid fuel, or one mixed with impurities.

For improving the fluidity of the mixture having thus been produced, there may advantageously be added thereto a stabilizing agent such as e.g. xanthane gum.

It has been found that, for obtaining a proper mixing, it was advantageous to use, when carrying out the emulsification, an alkaline agent having a pH ranging between 9 and 11. On another hand, it has also been found that if the final product is to be stored in a tank during more than a week, it will be advisable to treat the colloid with a bactericide agent so as to prevent bio-degradation. When use is made of water contaminated with phenol, the latter will provide this bactericid effect which protects the colloid.

If heavy hydrocarbons are to be emulsified, they may also be mixed with lighter hydrocarbons.

DETAILED DESCRIPTION OF THE INVENTION

The following non-limitative examples will be given so that the invention may be more readily understood.

EXAMPLE 1

When preparing, in a known manner, a mixture containing:

45% water, polluted by 5% sodium carbonate

20% waste mineral oil (such as drained from an engine sump)

35% coal from South Africa, ground, with 22% oversize on a 80 micrometers sieve, and if this mixture is very violently stirred, it will be found that it is impossible to obtain a homogeneous mixture, even when adding thereto tensio-active agents.

On the contrary, if in a first stage polluted water and mineral oil are mixed while adding thereto 0.15% of an ethoxylated nonylphenol having an HLB index of 17.1, a very fluid and stable emulsion is obtained; if, in a second stage, coal is added thereto, it will very readily and regularly be dispersed through this emulsion, and a homogeneous mixture will be obtained, free of any lumps or clusters.

The mixture being thus obtained is allowed to rest, and after a few hours a slight decantation of particles larger than 100 micrometers can be observed.

If then there is added to the previously obtained homogeneous mixture a dispersing agent such as xanthane gum in a proportion of 0.15 per 1,000, there is no longer any decantation, as particles remain very mobile throughout the mass.

The final homogeneous mixture thus obtained, starting from industrial wastes and lean coal can be stored in a tank and then be pumped and injected through the twyers of a burner.

EXAMPLE 2

It is generally difficult and hazardous to grind coal in the dry condition, so that it is preferred to do the grinding in the presence of water.

However, when coal has been ground in the presence of water and when it is subsequently attempted to incorporate the coal having thus been ground into hydrocarbons, it is not possible to obtain a homogeneous product.

Taking again the three products of Example 1, in which, however, the coal will be merely crushed, instead of being finely ground (which is both difficult and hazardous), the operation is carried out as follows:

A mixture is prepared, containing:

0.0500 kg of water contaminated with 5% $Na_2CO_3$ 0.200 kg of waste oil 0.300 kg of crushed South African coal slurry.

This mixture is placed in a laboratory-scale grinder consisting of a jar loaded with grinding agents. After operating the grinder for one half-hour, there is found therein a thick sludge of coal and oil in presence of water forming a clearly separated phase. Even when continuing the grinding operation during several hours, it is impossible to obtain a homogeneous mixture.

On the contrary, the test will succeed when operating as follows:

0.500 kg of polluted water and 0.200 kg of waste mineral oil are mixed at high velocity in presence of 2 milliliters of a tensio-active agent (ethoxylated nonylphenol having a HLB index of 17.1).

An addition is made of 0.300 kg of crushed South African coal and the mixture is immediately ground. After one half-hour, there is obtained a very fluid homogeneous liquid having a viscosity of 0.15 poise.

EXAMPLE 3

Operating in accordance with this invention, it will be possible to homogenize the following mixture:

50% water, polluted by 0.5% phenol

40% waste mineral oil

10% crushed petroleum coke

For this purpose, it will be necessary to emulsify at first the polluted water and the oil while adding the tensio-active agent, namely ethoxylated nonylphenol, but there will also be added 1% sodium carbonate, because for obtaining a suspension of petroleum coke and water, it is essential to add a dispersing agent. After the emulsification is completed it will be sufficient to pour in the petroleum coke.

As in Examples 1 and 2, this mixture is sufficiently homogeneous and stable for storage and from which it can be in a tank and pumped out and injected through the twyers of burners and boilers, so that a usable fuel is obtained, starting from industrial wastes and contaminated products.

EXAMPLE 4

By energetically kneading the following mixture:

40% water, polluted by 0.5% phenol

15% heating oil

45% South African coal, crushed as in Example 1 there is obtained a product which presents itself in two phases:

a sludge phase comprising coal with heating oil, an aqueous phase.

On the contrary, when energetically kneading the heating oil and the polluted water in the presence of 0.20% ethoxylated nonylphenol (HLB=17.1) and 0.05% of a polycolloid, there is obtained an emulsion into which crushed coal will subsequently be poured. The coal is then readily dispersed, so that there is obtained a homogeneous liquid, usable as a fuel.

EXAMPLE 5

This Example illustrates the application of the method according to this invention for extracting heavy fuel oil trapped in sand, that is for recovering this oil which will then become a component in a combustible mixture for industrial use, while simultaneously cleaning the sand.

This example is described using river sand, but it is also applicable to sea-shore sand having been polluted, as by crude oil leaking from a tanker vessel.

Taking 100 g of river sand soiled with heavy fuel oil, grade No. 2, the proportion being 70% sand and 30% fuel oil, the following emulsion is prepared: 80 g water+20 g white spirit, this mixture being vigorously stirred in presence of 0.2 g of ethoxylated nonylphenol.

Stirring this emulsion very vigorously with polluted sand makes it possible to separated the sand from the fuel oil. There is in fact thus obtained a phase consisting of water, white spirit and fuel oil, while the sand will have decanted out to the bottom.

Since the operation will have been carried out in an aqueous emulsion, it will then be possible to wash the sand with clean water, and this water may be recycled in the process.

This method can be carried out at room temperature, while doing away with the need for pure solvents.

As set forth in the examples, water comprises approximately 40 to 50 percent of the combined water, oily combustible materials, and fuel mixture, the oily combustible materials comprise from approximately 15 to 40 percent of the mixture, and the fuel comprises approximately from 10 to 45 percent of the mixture.

The method of this invention can be used for producing mixtures with:

polluted waters containing: hydrocarbons, alcohols, phenols, amines, soluble mineral salts, organic materials, vegetal or similar;

liquid hydrocarbons, hydrocarbon sludges (such as oily sludges), animal or vegetal organic sludges, mineral or organic fats, tar, drilling mud or the like;

mining products or mining wastes or by-products, such as schlamms, fine dust fractions, active carbon, carbon black sludge, petroleum coke sludge, steam-cracking residues, solidified tar, pitch, polluted earth or sand, and the like.

The above-mentioned dispersing agents have the purpose of acting upon the zeta potential of the particles for enhancing the dispersion thereof. Use can be made of: alkaline carbonates or silicates; sulfonated polynaphtalenes; lignosulfonates; polyacrylates.

I claim:

1. A method for forming homogeneous mixtures of aqueous residual liquids with oily combustible materials, comprising the steps of forming in a first stage a stable emulsion of an oily hydrocarbon fuel in water, adding a colloid to the emulsion, and mixing this oil in water emulsion, in a second stage, with a solid or liquid fuel.

2. A method according to claim 1, in which the stability of the emulsion is improved by adding thereto a tensio-active agent.

3. A method according to claim 2, in which the tensio-active agent has an HLB index ranging between 15 and 20.

4. A method according to claim 3, in which the tensio-active agent is a non-ionic polyoxyethylene derivative.

5. A method according to claim 4, in which the tensio-active agent is an ethoxylated nonylphenol having an HLB of 17.1.

6. A method according to claim 1, in which the colloid includes a silicate.

7. A method according to claim 1, in which the water used for forming the emulsion is an alkaline water with a pH ranging between 9 and 11.

8. A method according to claim 1, in which said oily hydrocarbon is a heavy-grade hydrocarbon fuel that is emulsified by adding a light-grade hydrocarbon fuel during said first stage.

9. A method according to claim 1, in which a light-grade hydrocarbon fuel is added for emulsifying a heavy grade hydrocarbon fuel during said first stage.

10. A method according to claim 1, in which a previously crushed solid fuel is added to the emulsion, followed by subsequent grinding.

11. A method according to claim 9, in which a dispersing agent is added to the emulsion and solid fuel mixture.

12. A method according to claim 1, in which the water is polluted by a contaminant selected from the group consisting of hydrocarbons, alcohols, phenols, amines, soluble mineral salts, organic materials and vegetal substances.

13. A method according to claim 1, in which the oily combustible material that is emulsified in water is selected from the group consisting of liquid hydrocarbon, hydrocarbon sludges, organic sludges, mineral or organic fats, tar, and drilling mud.

14. A method according to claim 1, in which the aqueous residual liquids added after emulsification are selected from the group consisting of liquid hydrocarbon, hydrocarbon sludges, organic sludges, mineral, organic or vegetal fats, tar, and drilling mud.

15. A method according to claim 1, wherein said colloid comprises solid combustible materials added after emulsification and selected from the group consisting of mining products or by-products; schlamms; fines resulting from dust removal; active carbon; carbon black sludge; petroleum coke sludge; steam-cracking residues; solidified tar; pitch; and polluted earth or sand.

16. A method according to claim 11, in which the dispersing agents are selected from the group consisting of alkaline carbonates and silicates; sulfonated polynaphtalenes; lignosulfonates and polyacrylates.

17. A method according to claim 10, in which a dispersing agent is added to the emulsion and solid fuel mixture.

18. A method according to claim 2, in which the tensio-active agent has an HLB index of 17.

19. A method for forming homogeneous mixtures of aqueous residual liquids with oily combustible materials, comprising the steps of forming in a first stage a stable emulsion of an oily hydrocarbon fuel in water adding a colloid to the emulsion, and mixing this oil in water emulsion, in a second stage, with a solid or liquid fuel, wherein said water comprises approximately 40 to 50 percent of the combined water, oily combustible materials, and fuel, and wherein the steps of the process are performed at ambient temperatures.

20. A process according to claim 19, wherein said water has a pH of from 9 to 11, said oily combustible materials are selected from the group consisting of liquid hydrocarbon, hydrocarbon sludges, organic sludges, mineral, organic fats, tar, and drilling mud, said oily combustible materials ranging approximately from 15 to 40 percent of the combined water, oily combustible materials, and fuel, and said fuel is selected from the group consisting of liquid hydrocarbon, hydrocarbon sludges, organic sludges, mineral or organic fats, tar, drilling mud, mining products or by-products, schlamms, fine dust fractions, active carbon, carbon black, petroleum coke, steam-cracking residues, solidified tar, pitch, and polluted earth or sand, said fuel ranging in amount approximately from 10 to 45 percent of the combined water, oily combustible materials, and fuel.

21. A method according to claim 20 wherein at least one of a tensio-active agent, a light grade hydrocarbon, a colloid, and a pollutant is added prior to said second stage, and a dispersing agent is selectively added after said first stage, wherein said tensio-active agent has an HLB index ranging from 15 to 20, said pollutant is at least one of a hydrocarbon, alcohol, phenol, amine, soluble mineral salt, organic material and vegetal substance, and said dispersing agent is at least one of alkaline carbonate, alkaline silicate, sulfonated polynaphtalene, lignosulfonate and polyacrylate.

22. A method according to claim 1, wherein said colloid includes xanthane gum.

23. A method according to claim 21, wherein said colloid includes xanthane gum.

* * * * *